United States Patent [19]

Castellarin

[11] Patent Number: 4,607,930

[45] Date of Patent: Aug. 26, 1986

[54] DEVICE FOR TRANSFERRING THE FILM HOLDERS IN A FILM DEVELOPER

[75] Inventor: Silvano Castellarin, Pordenone, Italy

[73] Assignee: Gretag San Marco S.p.A., Pordenone, Italy

[21] Appl. No.: 688,500

[22] Filed: Jan. 3, 1985

[30] Foreign Application Priority Data

Jan. 3, 1984 [IT] Italy ..... 45702 A/84

[51] Int. Cl.[4] ..... G03D 3/08

[52] U.S. Cl. ..... 354/322; 134/76

[58] Field of Search ..... 354/316, 320, 322; 134/76

[56] References Cited

U.S. PATENT DOCUMENTS 3,469,517 9/1969 Nishimoto ..... 354/322
4,475,799 10/1984 Castellarin ..... 354/322

FOREIGN PATENT DOCUMENTS 2043490 10/1980 United Kingdom ..... 354/322
2108706 5/1983 United Kingdom ..... 354/322

*Primary Examiner*—A. A. Mathews
*Attorney, Agent, or Firm*—Wenderoth, Lind & Ponack

[57] ABSTRACT

Device for transferring the film holders in a film developer which was described by the Italian patent application No. 45731 A/82 of the same Applicant. Such a device is constituted by an arm (1) formed by two rods, a first fixed rod (2) which is applied in the same manner and is actuated by the same means provided to actuate the transferring arm of the above film developer, and a second movable rod (3) which is longitudinally slidable with respect to said fixed rod (2) and may assume two operating positions, a first position in which all the fork elements (21–31) which are arranged on both rods are equally spaced each other, so as to be able to catch a respective film holder (7) and to transfer it for each time in which said arm (1) is actuated.

When the second movable rod (3) is shifted in its second operating position, the fork elements (31) which are disposed on said second movable rod (3) are so shifted as to avoid the respective film holders (7) to be caught and transferred, wherein said arm is cyclically actuated within time periods which are submultiple of the time period in which the development stage is carried out.

The movable rod (2) is provided with a pin (32), which bears against a deviation lever (33) having two operating positions when the arm (1) is shifted, in such a manner as to shift said movable rod (2) in its two operating positions.

6 Claims, 3 Drawing Figures

DEVICE FOR TRANSFERRING THE FILM HOLDERS IN A FILM DEVELOPER

BACKGROUND AND SUMMARY OF THE INVENTION

The present invention relates to a device for transfer ring the film holders of a film developer in the succession of the tanks containing the various chemical baths. This device permits the different stages of the film development cycle to be performed within a time which is near to the recommended minimum time, which results in a considerable reduction of the entire treatment time. Such a device is an improvement over to the film developer described in the applicant's U.S. Pat. No. 4,475,799 issued on Oct. 9, 1984, and to which further reference will be made.

In such a developer, transfer of the film holders in the succession of the treatment tanks is performed in a succession of stages within times which are equal or multiple with reference to the time utilized for performing the first basic stage, the so-called development stage.

As is already known, the required minimum times recommended by the film manufacturers for permitting the several stages of the entire development cycle to be completely carried out, are different: some manufactures recommend times which are shorter than the time utilized for performing the first stage, the so-called development stage, while other manufactures on the contrary, recommend times which are longer but less than that time.

The transferring system, provided on the film developer referred to, permits the films to be immersed into the baths relating to the stages which are subsequent to the first stage and these films remain immersed therein for time periods which are longer that the recommended minimum time period.

Consequently, the overall time period, which is recommended for permitting the entire development cycle to be carried out, is greater than that which is really necessary. It is known, that the time periods in which the films remain immersed in the baths, during such stages, are longer than the recommended minimum ones and do not cause problems as far as the image quality is concerned. It would be clearly desirable and is an object of the present invention to shorten these time periods, in such a way as to bring the time periods for each single stage nearest to the respective recommended minimum time period, so as to shorten the required time period for carrying out the entire development cycle. This object is obtained by the device according to the present invention, which is constituted by a transferring arm similar to that one provided on the film developer of U.S. Pat. No. 4,475,799 but different with respect thereto, said device being characterized in that said transferring arm is constituted by two rods, a first fixed rod which is applied in the same manner and is actuated by the same means provided for actuating the above described transferring arm on the said film developer and a second movable rod which is longitudinally slidable with respect to said first fixed rod; fork elements being also provided to engage the film holders and transfer them some fork elements being disposed on said first fixed rod and some fork elements on said second slidable rod, the slidable rod being also positionable in two different positions with respect to said first fixed rod comprising a first position in which all the fork elements are disposed equally spaced from each other so as to be able to engage and transfer a respective film holder for any actuation of the arm, and a second portion in which the fork elements which are disposed on the said second slidable rod are so shifted such that they do not engage or transfer the respective film holders, the arm being cyclically actuated within time periods which are submultiples of the time period in which the development stage is carried out, so that the double positioning of the slidable rod permits the time periods in which the film remains immersed into the different tanks to be varied, from a minimum time period corresponding to that one of an actuating cycle of the arm, to time periods which are multiple with respect to that time period but which are not double with respect to the time period in which the development stage is carried out; a shifting device being also provided to control in a cyclical manner the shiftings and positionings of the slidable rod; the device further comprises synchronization means which hold the actuating cycles of the slidable rod and the actuating cycles of the arm in a correct relationship, and also comprises control and safety means.

BRIEF DESCRIPTION OF THE DRAWINGS

The operation and the features of the present invention will be better understood from the following description in conjunction with the accompanying drawings wherein.

DETAILED DESCRIPTION

Figure 1:
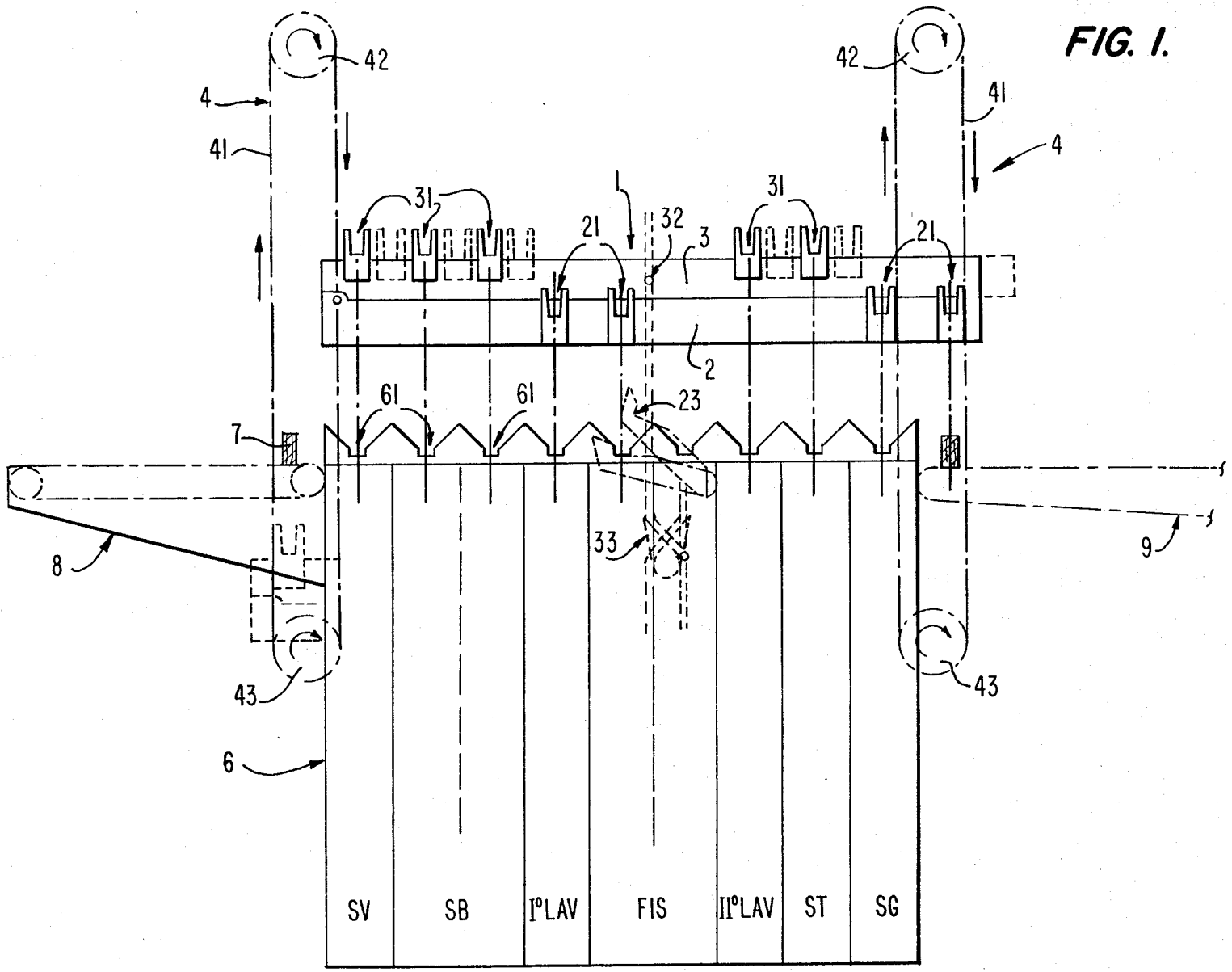
FIG. 1 shows schematically the device according to the present invention, together with a part of the film developer.

The device according to the present invention includes an arm 1 formed by a first fixed rod 2 and a second slidable rod 3. The slidable rod 3 is connected to the fixed rod 2 and is longitudinally slidable with respect thereto. Fork elements, which are equally spaced one step apart from each other, are fixed onto said rods, and fork elements 21 being fixed onto the fixed rod 2 and movable fork elements 31 being fixed onto the slidable rod 3.

The fork elements are distributed such that there are three movable fork elements, two fixed fork elements, a free position, then two other movable fork elements which are followed by two other fixed fork elements. A pawl device 23 is placed in a developing tank at the free position, for transfer of the film holders.

The fixed rod 2 is fixed at two positions to the two conveyor chains 41 of the vertical shifting and transferring systems 4, which chains actuate said arm 1, producing in a known manner which will later be fully described, the transferring of the film holders 7.

As is clearly evident from FIG. 1, the two vertical shifting and transferring systems 4 are formed by the two chains 41, each of which are linked and tensioned around the respective upper and lower sprocket wheels 42 and 43, to form a closed ring path. The chains are dimensioned such that the reciprocal distance of the respective parallel vertical portions thereof will determine the length of the cyclical progressions (transfers) of the film holders 7 through the film developer, this length being hereinafter called "progression step" or, more simply, "step".

The slidable rod 3 is also provided with a pin 32 later which will be more fully described, which during operation bears against a deviation lever 33. The deviation lever 33 has two operating positions and causes the slidable rod 3 to be shifted and positioned with respect to the fixed rod 2. The deviation lever 33 can be controlled in its two positions by a suitable device such as an electromagnet or similar means.

Figure 2:
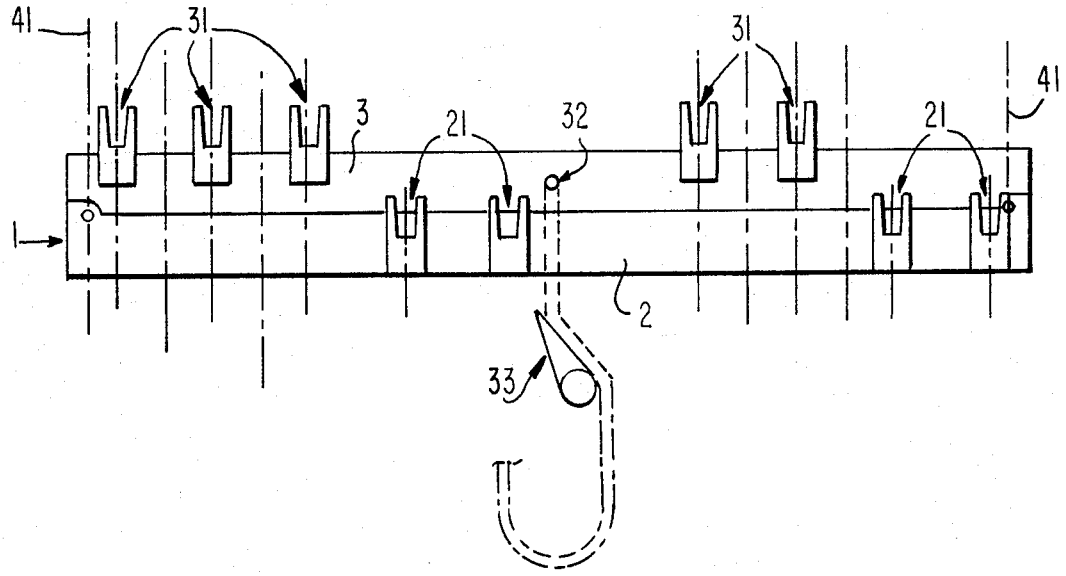
FIGS. 2 and 3 show schematically the present device in a first and second operating position respectively as well as the system for shifting a slidable part of the device.
Figure 3:
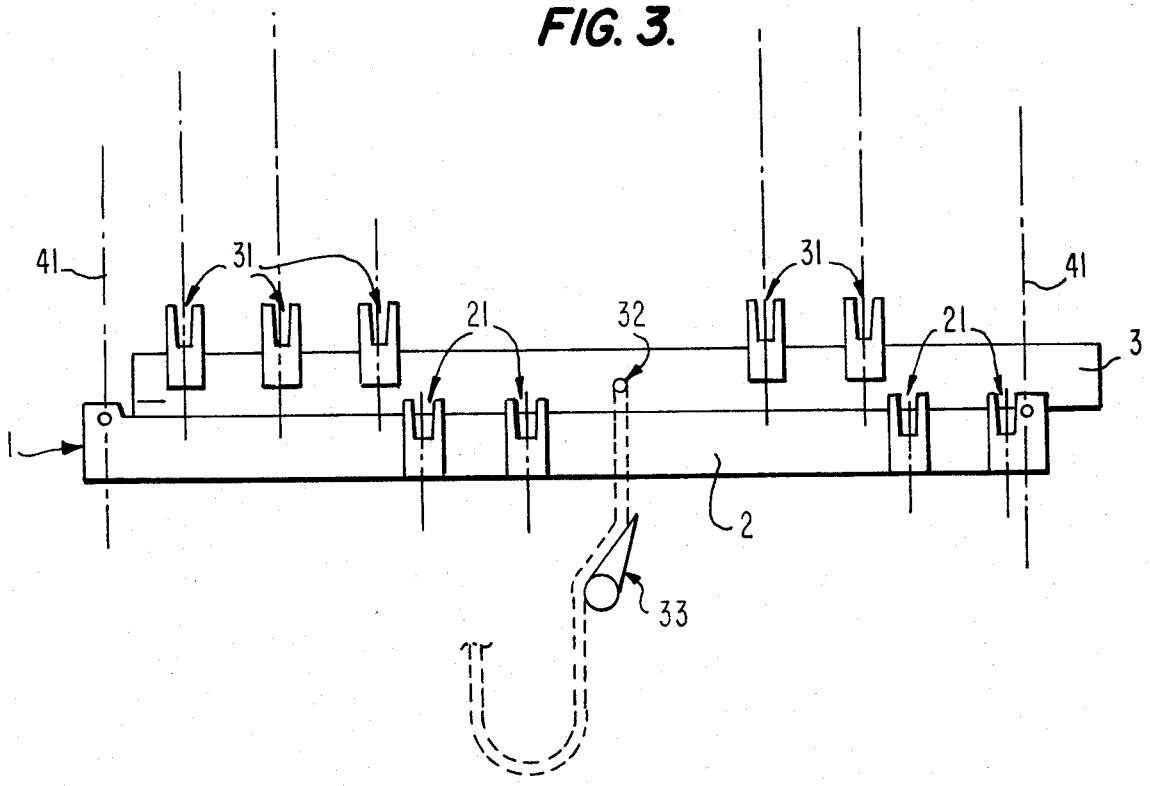

As a result thereof, the movable rod 3 will be shifted by about ½ step in a cyclical manner, so that the slidable rod 3 will assume a position as shown in FIG. 2 for two complete actuating cycles of the arm and a position as shown in FIG. 3 during the subsequent cycle.

The arm 1 is horizontally arranged on the side of the group of tanks 6, which contains the various chemical baths and forms part of the film developer. To provide greater detail, the single tanks are identified by the initial letters concerning the various stages of the development process, considered in their known succession and which are: developer SV, whitening SB, first washing I°LAV, fixing FIS, second washing II°LAV, stabilizer ST, dripping SG.

As it may be clearly seen in the same FIG. 1, the tanks SB and FIS are twice the length of the developer SV tank, while the other tanks are of the same length as the developer SV tank. In addition, on both upper lateral sides of the group of tanks 6 are recesses 61 which are equally spaced by one step from each other into which the film holders 7 may be disposed in the manner hereinafter described. It can be seen from FIG. 1, that the feeder 8 for the film holders 7 and the conveyor 9 in the film drying zone, both form part of the present film developer.

The device operates in the following way: at the beginning of the first operating cycle the arm 1 is positioned as indicated by a dashed line in FIG. 1, in such a manner that the first movable fork element 31 is disposed below the film holder 7, which in turn is arranged on the feeder 8.

As the vertical shifting and transferring systems 4 are actuated, the first operating cycle of the present device is started, whereby the arm 1 comes up and its first movable fork element 31 engages the film holder 7, followed by shifting it upwardly and then towards the inner part of the film developer, wherein said film holder 7 is positioned above the first tank SV and successively, by a downward movement, is disposed into the first recess 61 which is provided on the upper edge of that tank, so that the film which is held on this film holder is immersed into the tank SV.

Through its continuous downward movement, the arm 1 brings the pin 32 of its slidable rod 3 to bear against the deviation lever 33, which is in a first position as illustrated in FIG. 2 and with a marked dashed line as shown in FIG. 1, so that the pin 32 will slide on the inclined surface of the deviation lever 33, which results in a shifting of the slidable rod 3 to the position shown in FIG. 3.

In FIG. 1 it is also clearly illustrated by a thin dashed line, the new position of the slidable rod 3 and the relevant movable fork elements 31. The operating cycle continues until the arm 1 goes back to its starting position, at which it stops for a suitable time period determined by an appropriate timer. At the end of such a time period, the timer will start an additional operating cycle and so on.

In the following operating cycle, since the slidable rod 3 is shifted to the position as above described, the first and second movable fork elements 31 will not engage either the subsequent film holder 7, which in the meantime will have assumed the position of the previous film holder on the feeder 8, nor film holder which was disposed into the first recess 61, so that the cycle will end without causing any transfer of those film holders.

During this second cycle, only when the arm 1 has gone beyond the deviation lever 33, will the deviation lever be moved to a second position as shown in FIG. 3 and with a thin dashed line as shown in FIG. 1. As a result, the slidable rod 3 remains in the preceding position and a third operating cycle may occur without transfer of the film holders 7.

However, at the end of the third cycle, after the arm 1 is over the position in which the film holders 7 were disposed into the recesses 61, the pin 32 again bears against the deviation lever 33 which is shifted to its second position, so that the slidable rod 3 together with the respective movable fork elements 31 will be shifted to the starting position. The deviation lever 33 is always controlled in the same sequence, namely: it is shifted in the first position for two operating cycles and in the second position for one operating cycle.

Then, during the fourth operating cycle the film holder 7 which was disposed into the first developer tank SV will be engaged by the second movable fork element 31 and disposed in correspondence with the first part of the subsequent whitening tank SB. At the same time, a new film holder 7, which is now in the position previously assumed by the first one on the feeder 8, will be engaged by the first movable fork element 31 and disposed into the first developer tank SV in place of the previous film holder.

During the fifth and sixth operating cycles the conditions of the second and third operating cycles are repeated, so that no transfer may occur.

During the seventh operating cycle, the slidable rod 3 is again shifted to its first position, so that the the first film holder 7 is transferred in correspondence to the second part of the same whitening tank SB, while the second film holder is transferred from the developer tank SV to the first part of the whitening tank SB and a new third film holder 7 is loaded into the developer tank SV, all three film holders being moved simultaneously.

During the eighth and ninth operating cycles the slidable rod 3 again comes back to its second position, so that the second and third film holders 7 remain in their respective positions, while the first film holder is engaged by the first fixed fork element 21 and transferred to the next tank of the first washing bath I°LAV and during the ninth cycle it is engaged by the second fixed fork element 21 and transferred to the first part of the subsequent fixing tank FIS.

From here reference is now made to the path concerning only the first film holder 7, since the following film holders 7 clearly will move in the same manner as it. The first film holder 7, therefore, during the subsequent tenth operating cycle, is shifted in correspondence to the second part of the same fixing tank FIS, by means of the pawl device 23, since this zone is not provided with fork elements.

During the following two operating cycles, namely the eleventh and twelfth from the beginning, the slidable rod 3 finds itself in its second operating position so that the film holder 7 is not engaged by any fork element and therefore remains in the same position. During the thirteenth operating cycle the slidable rod 3 finds itself again in its first operating position, so that the fourth movable fork element 31 will engage the film holder 7 and transfer it to the following tank II°LAV, in which the second washing is carried out.

Successively, the film holder 7 remains in this position during the subsequent two operating cycles (the fourteenth and fifteenth), since the slidable rod 3 again finds itself in its second position.

During the sixteenth operating cycle the slidable rod 3 is again shifted to its first operating position, so that the film holder 7 is engaged by the fifth movable fork element 31 and transferred to the following stabilizer tank ST. Subsequently during the seventeenth operating cycle, the film holder 7 is engaged by the third fixed fork element 21 and transferred to the dripping tank SG.

Finally, during the eighteenth operating cycle the film holder 7 is caught by the fourth and last fixed fork element 21 and transferred on the conveyor 9 of the drying zone.

The present invention is an improvement over the device shown in U.S. Pat. No. 4,475,799 for transferring the film holders, which is designed to actuate a one piece arm, within time periods which are equal to the time period in which the film was immersed into the development bath.

In contradistinction, the device according to the present invention utilizes a two piece arm, which is actuated within time periods which are submultiples of the time periods used in U.S. Pat. No. 4,475,799.

Thus in U.S. Pat. No. 4,475,799, therefore, the stages requiring time periods which are shorter than the development time period, will still however be performed within the same time period as this development time period. In the same manner, the stages requiring a time period which is longer but not a multiple of the development time period, will nonetheless be performed within a time period which is a multiple of the above development time period, which is a longer than is necessary. As such, unnecessary wastes of time are involved. In the present invention, on the other hand, the various stages may be performed within time periods which are very close to the required minimum time periods. Thus a considerable savings in time may be obtained.

I claim:

1. A device for transferring film holders in a film developer having a film holder transfer arm mounted between a pair of vertical endless conveyor chains, each of which is mounted for rotation on either side of a group of successive tanks containing various chemical baths for developing film hanging from the film holders, a feeder located adjacent the entrance end of the group of tanks and a conveyor located adjacent the exit end of the group of tanks, the transfer device comprising:

a transfer arm having a first rod extending in a longitudinal direction and adapted to be attached to the vertical endless chains of the film developer for movement therewith and a second rod slidable in said longitudinal direction along said first rod;

fork means, disposed along said first and second rods, for engaging and transferring film holders from the feeder into recesses along the upper edges of successive tanks and finally onto the conveyor of the film developer;

means for moving said second rod to a first position at which all of said fork means are operable to engage and transfer a respective film holder to a successive position along the film developer and to a second position at which said fork means on said first rod remain operable to transfer respective film holders and said fork means on said second rod are inoperable to engage the transfer any film holders, whereby said fork means disposed on said first and second rods effect transfer of film hanging from film holders through the various stages of film development within time periods close to minimum required time periods at each stage of the development process.

2. The device of claim 1, wherein said fork means are disposed at equally spaced positions when said second rod is in said first position and said fork means on said second rod are offset with respect to said fork means on said first rod when said second rod is in said second position.

3. The device of claim 1, wherein said means for moving said second rod includes a pin attached to said second rod and a deviation lever adapted to be pivotably attached to one of the tanks of the film developer, said deviation lever being positionable in a tank for causing said pin to shift said second rod to either said first position or said second position.

4. The device of claim 3, wherein said deviation lever has two surfaces which taper from a thick end towards a thin end thereof, said thick end being adapted for pivotal attachment to a tank of the film developer and said thin end being movable to opposite inclined positions in said longitudinal direction for causing said pin to shift said second rod to either said first position or said second position.

5. The device of claim 2, wherein said fork means are located at ten successive equally spaced positions along said first and second rods from the entrance end of the group of tanks in the following order when said second rod is in said first position, three fork means on said second rod, two fork means on said first rod, a free position without a fork means on either said first or said second rod, two fork means on said second rod and two fork means on said first rod.

6. The device of claim 5, further comprising, a pawl means adapted to be pivotally attached to a tank of said film developer, at a position corresponding to said free position, for engaging and transferring a respective film holder from a position corresponding to said free position to the next successive position while maintaining the film hanging from the respective film holder in the same tank.

* * * * *